United States Patent [19]

Kessler, Jr. et al.

[11] Patent Number: 4,601,331

[45] Date of Patent: Jul. 22, 1986

[54] MULTIPLE HEAT PIPES FOR LINEAR BEAM TUBES HAVING COMMON COOLANT AND VAPORIZING SURFACE AREA ENHANCEMENT

[75] Inventors: Sebastian W. Kessler, Jr., San Mateo; Gordon R. Lavering, Belmont, both of Calif.

[73] Assignee: Varian Associates, Inc., Palo Alto, Calif.

[21] Appl. No.: 768,541

[22] Filed: Aug. 23, 1985

[51] Int. Cl.[4] ..... H01J 7/28; F28D 15/00

[52] U.S. Cl. ..... 165/104.33; 165/104.26; 165/135; 313/12; 313/44

[58] Field of Search ..... 165/104.33, 104.26, 165/47, 185; 313/12, 30, 39, 44

[56] References Cited

U.S. PATENT DOCUMENTS 2,758,245 8/1956 Varian ..... 313/44

3,405,299 10/1968 Hall et al. ..... 313/12

3,965,334 6/1976 Asselman et al. ..... 165/104.26

4,169,387 10/1979 Krempl ..... 165/47

FOREIGN PATENT DOCUMENTS 1498799 1/1978 United Kingdom ..... 313/30

*Primary Examiner*—Albert W. Davis, Jr.

*Attorney, Agent, or Firm*—Stanley Z. Cole; Kenneth L. Warsh

[57] ABSTRACT

A linear beam tube has multiple heat pipes formed integrally in the cavity wall between the beam collector and external air cooling fins. The heat pipes use sintered copper pellets on the walls of the pipes as wicks to facilitate the return flow of liquid condensed at the fins. Circumferential channels connect the heat pipes at each end to reduce vapor lock effects. Vapor surface area enhancement rods are used at the heat source to increase the transfer rates of heat into the fluid.

11 Claims, 21 Drawing Figures

HEAT OUT
14

18
HEAT
20
24
AIRFLOW
16
10
HEAT IN
22
12

30
38
$T_4$
$T_3$
AIR
36
34
CONDUCTED HEAT
$T_2$
$T_1$
32
VACUUM 30
38
$T_8$
$T_7$
VAPOR TRANSPORTED HEAT
AIR
$T_6$
$T_5$
32
VACUUM

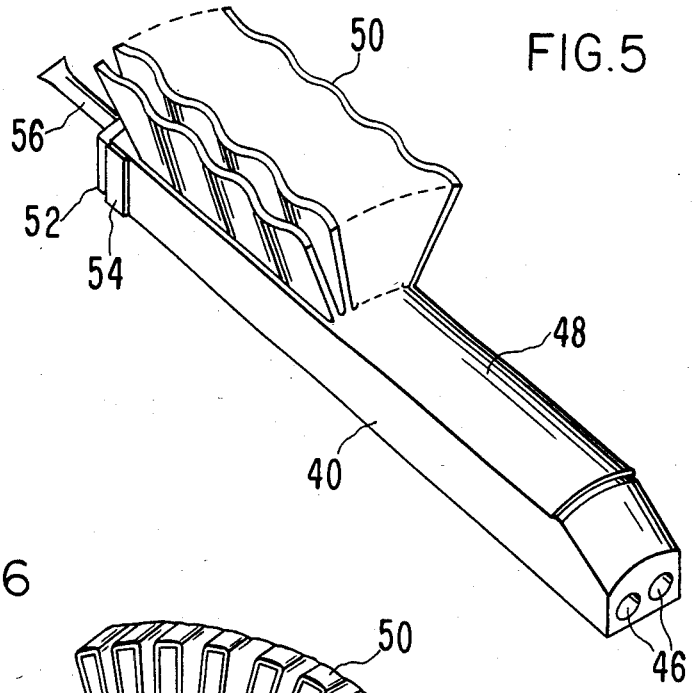
FIG.5
FIG.6
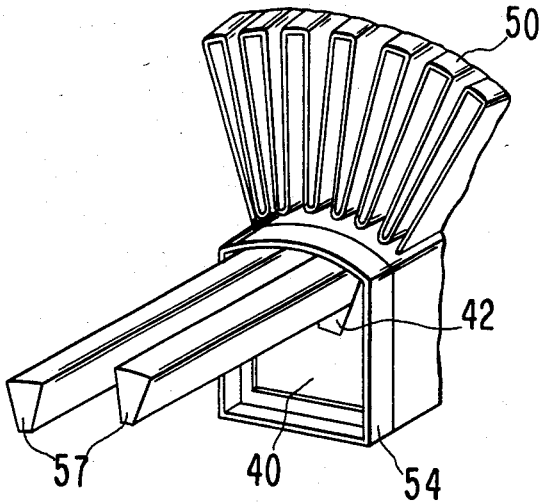
FIG.7A
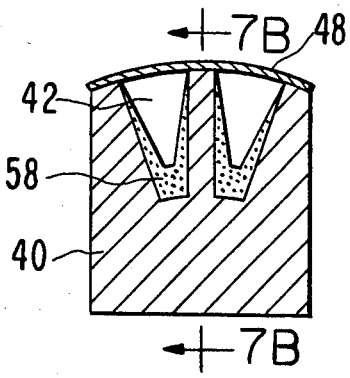
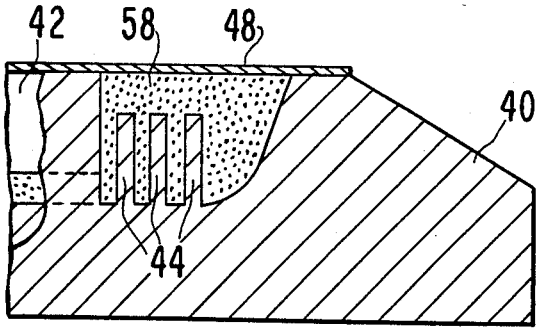
FIG.7B 61
62
63
64
65
66
67
68
69
70
72
74
75
60
44
14
15

MULTIPLE HEAT PIPES FOR LINEAR BEAM TUBES HAVING COMMON COOLANT AND VAPORIZING SURFACE AREA ENHANCEMENT

FIELD OF THE INVENTION

This invention pertains to apparatus used to cool microwave tube collectors and more particularly to integral heat pipes in the cavity wall used to transfer heat to external cooling fins.

BACKGROUND OF THE INVENTION

Linear beam vacuum tube devices dissipate power in the form of waste heat. Requirements for increased power performance and higher frequency operation add thermal dissipation penalities to the tube structure. As the frequency of the linear beam tube increases, the physical size of cavity components decreases. This increases the cavity wall power density. To increase the power handling capability of any cavity configuration, conductive cooling paths must be shortened or the cooling paths must be thermally shorted within the same material volume, thereby reducing the temperature difference between the inside and outside of the cavity wall.

OBJECTS OF THE INVENTION

It is therefore an object of the invention to describe an apparatus for conducting heat in the walls of a linear beam tube from the heat source to a heat sink.

It is a further object of the invention to describe such an apparatus which will not require external sources of cooling liquids.

It is still another object of the invention to describe such an apparatus which does not require an appreciable increase in thickness of the cavity walls.

SUMMARY OF THE INVENTION

Multiple heat pipes are incorporated integrally into the cavity wall between the source of heat and the cooling fins of the tube. The heat pipes use sintered copper pellets in the walls of the pipes as wicks to facilitate the return flow of liquid condensed at the fins. Circumferential channels connect the heat pipes at each end to reduce vapor lock effects. Vapor surface area enhancement rods are used at the heat source to increase the transfer rate of heat into the fluid.

These and further constructional and operational characteristics of the invention will be more evident from the detailed description given hereinafter with reference to the figures of the accompanying drawings which illustrate one preferred embodiment and alternatives by way of non-limiting examples.

BRIEF DESCRIPTION OF THE DRAWINGS

FIG. 5 is a view of the assembled test device of FIGS. 3 and 4.

FIG. 6 illustrates the method of forming the wick by sintering on tapered, greened, stainless steel mandrels.

FIGS. 7A and 7B show the sintered wick within the heat pipes.

FIG. 12 shows various embodiments of vapor surface area enhancement rods, FIG. 12*a* showing rectangular rods, FIG. 12*b* showing circular cylindrical rods and FIG. 12*c* showing pointed rods.

DESCRIPTION OF THE PREFERRED EMBODIMENTS

Figure 1:
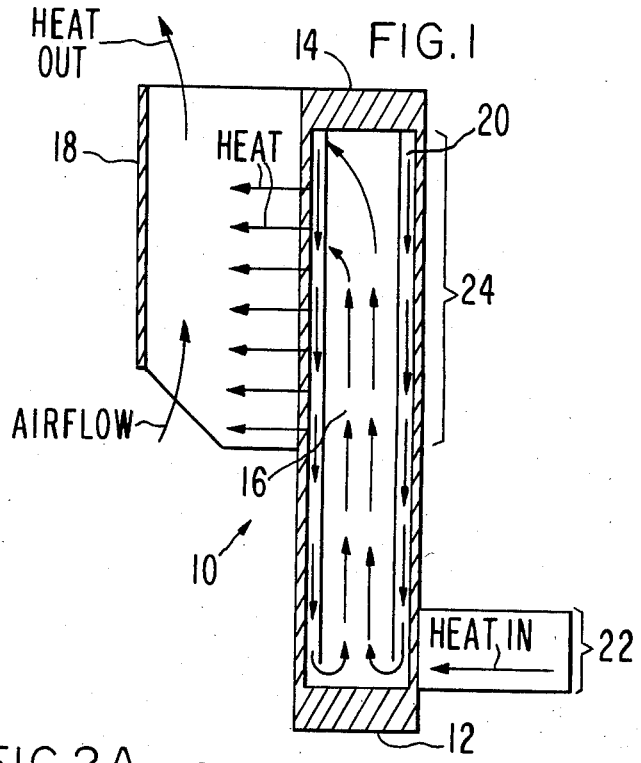
FIG. 1 shows a schematic diagram of the basic elements of a heat pipe.

Referring now to the drawings wherein reference numerals are used to designate parts throughout these various figures thereof, there is shown a heat pipe 10 which is a sealed liquid/vapor filled volume. Heat is applied externally to one end 12 and removed externally from the other 14. The input heat causes enclosed liquid phase material to evaporate. The evaporated material, containing the latent heat, flows from the heated end 12 to the cooled end 14 of the heat pipe 16. The output end of the heat pipe is externally cooled in some fashion so that the vapor within the heat pipe will condense on the inner surface and run back down the tube to again be evaporated, such as by use of fins 18 and air cooling. In some applications, the liquid return is accomplished by surface tension within a wick. The basic heat pipe is a sealed tube with a tubular wick, or capillary structure 20 attached to the inner surface of the heat pipe. A volatile liquid, such as water, sodium, or ammonia, fills the pores of the wick. When heat is applied to one end, the evaporator region 22, the liquid phase coolant evaporates, absorbing the heat as the latent heat of evaporation. The vapor is transported through the tubular core within the wick. The vapor travels towards the slightly cooler region of the heat pipe where it condenses. The heat then conductively transfers to external air-cooled fins 18. This is the radiator, or condenser region 24. The condensed liquid is then transported by surface tension through the wick to the heated, or evaporator region, for recycling.

The coolant in a heat pipe functions, in effect, as a thermal short. In addition, a heat pipe acts as a thermal transformer; it accept heat at a high-power density and dissipates the heat at a lower-power density. To realize the advantage of a heat pipe as a heat power transfer device, consider a long solid copper block and a heat pipe having the same outer dimensions. When conducting heat the thermal resistance of a water heat pipe has been measured to be less than 1/10,000 that of the solid copper rod. This efficient thermal transport is accomplished by the vapor which transports heat from the evaporator to the condenser of the heat pipe at velocities less than Mach 1.

Electron beam devices having reentrant collectors are subject to local collector core overheating. This usually occurs just inside the beam aperture, furthest from the collector's cooling fins.

Figure 2A:
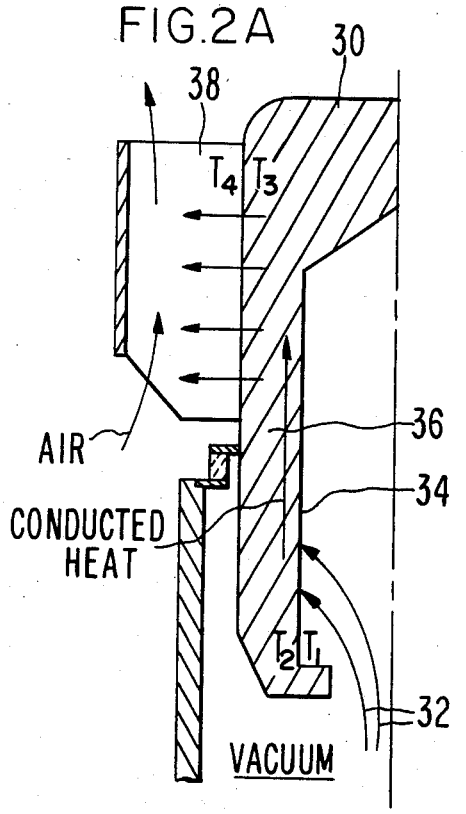
FIG. 2*a* is a schematic diagram which illustrates the problem of local overheating in the prior art.

FIG. 2*a* demonstrates why local melting sometimes occurs on the inside of a collector 30 of a linear beam tube. Most of the wasted power in the spent electron beam 32 is transferred to the lower inner surface 34 of the collector. This power must then be conducted up the core 36 and into the cooling fins 38. The length of the conduction path between the heated core area and the cooling fins results in a temperature drop between $T_1$ and $T_3$. This temperature differential can be appreciable and has been measured in an actual VKU-7791 klystron to be in excess of 550° C. when operating at 2 kW r.f. power (8.8 kW thermal dissipation). With $T_4$ operating at 200° C., $T_1$ was found to exceed 695° C. ($\Delta T = 695 - 200 = 495°$ C.).

Figure 2B:
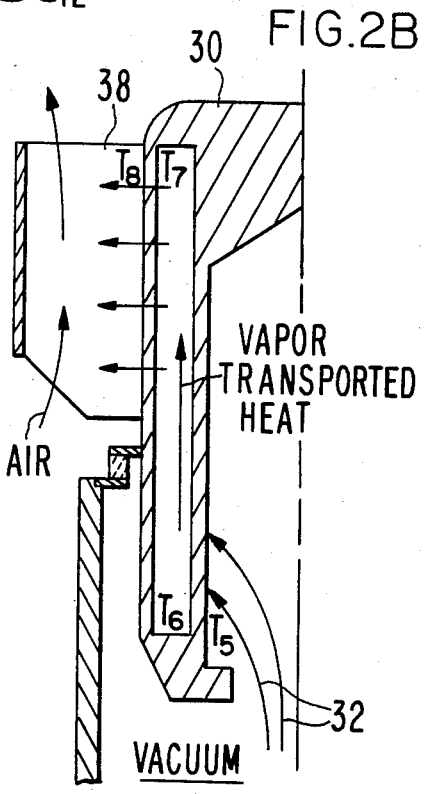
FIG. 2*b* is a schematic diagram which illustrates how the invention prevents the local overheating in the prior art.

FIG. 2*b* shows the same collector configuration, but with heat pipes build integral to the collector core. With this configuration, $T_5$ is slightly greater than $T_6$, $T_6 \approx T_7$, and $T_8$ is slightly less than $T_7$. As a result, the temperature drop between $T_8$ and $T_5$ has been demonstrated by tests to be about 85° C. when a heat pipe cooled tube is operating at 2 kW r.f. power (8.8 kW thermal dissipation). With $T_8$ operating at 190° C., $T_5$ may be as low as 275° C.

The two examples above show that the addition of heat pipes can reduce the hottest inner core surface temperature of an operating klystron. This also suggests that the heat pipe cooled collector is capable of increased power handling capability.

A feasibility test was conducted in order to demonstrate possible advantages of applying heat pipes to reentrant collector configurations. The configuration chosen for these experiments was similar to the VKU-7791 klystron.

A thermal evaluation model was developed that was a full scale core assembly, but only a $\frac{1}{8}$ (45°) section when looking along the axis of the tube. Holes were added to the bottom of the pie-shaped section and thermal rods were inserted for simulating the electron beam impingement. The thermal rods could simulate the power into the collector section, but could not duplicate the actual local power density pattern.

Figure 3:
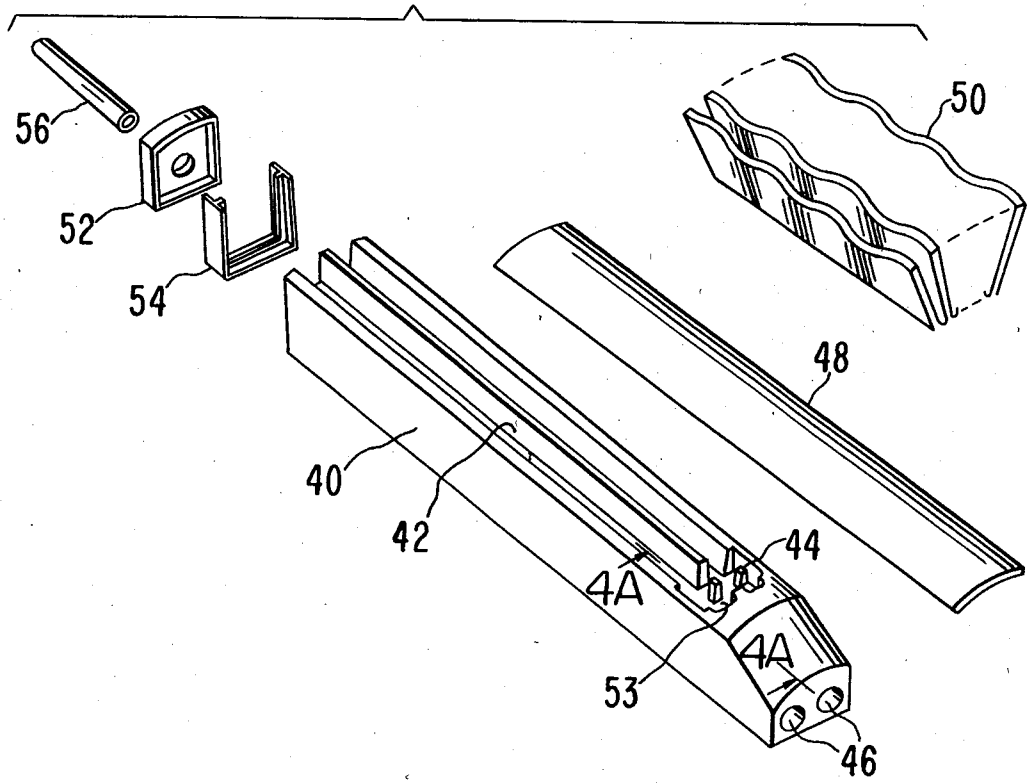
FIG. 3 shows an exploded view of the assembly used to make measurements of the improved performance of the invention.

The elements of the thermal pipe model are shown in FIG. 3. A $\frac{1}{8}$ collector core 40 was machined out of a solid copper bar. Grooves 42 for two heat pipes were machined into the core. Vapor surface area enhancement rods 44 were formed by machining circumferential grooves around the core at the heated end. Two holes 45 for thermal rods are also shown in FIG. 3. A bent cover plate 48 was formed. For a complete collector configuration, this would be a cylinder designed to slip down over the collector core. Cooling fins 50 were brazed to the cover plate. These were of the correct size and shape for an actual klystron. A heat pipe cap 52 and rim assembly was designed with a common coolant transfer path interconnecting the two heat pipes.

Figure 4A:
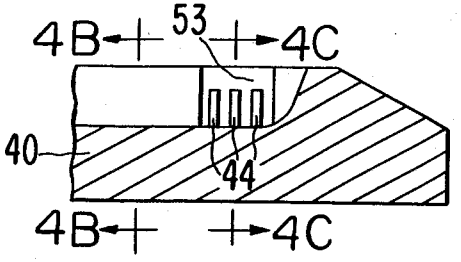
FIGS. 4*a, b* and *c* are detailed sections of the high temperature end of the heat pipes in the device in FIG. 3 showing the detail of the vapor surface area enhancement rods.

The evaporator sections, too, are interconnected by circumferential grooves in forming the vapor surface enhancement rods 44. The surface area enhancement rods 44 are shown with grooves 53 interconnecting the evaporator sections in FIGS. 4*a, b* and *c*.

The heat pipe rim 54 was brazed to the collector core prior to adding the wick. The means for making a wick will be described below. Following inclusion of the wick, the heat pipe cap 52, with an attached water fill tubulation 56, was Heliarc welded to the heat pipe rim. Water was poured into the tubulation 56, the surplus was removed by the method described below and then the assembly is nipped off. A closed loop system, or heat pipe cooled collector assembly was the result. FIG. 5 shows the complete $\frac{1}{8}$ tube heat pipe assembly. To test, thermal rods are inserted into the two holes, power is supplied to the thermal rods and air is forced through the cooling fins. Thermal data were taken with thermocouples located at various points on the structure. The heat pipe operating pressure was also recorded.

The wick mentioned must be capable of allowing steam to transfer from the evaporator surface in the heat pipe to the vapor transport region. This requires a porous material. The same material, however, must allow returning liquid water to be transported along its surface by capillary action. This requires the liquid return path to have a maximum of surface area. A wick, therefore, is best comprised of an extremely porous, high-surfaced material.

Wick materials are chosen in design for maximum effect with the heat pipe coolant used. These wicks are typically glass fiber, stainless steel wool, tungsten wool, or copper. When considering which wick material to use, the means for making it stay in contact with the heat pipe's inner walls must be considered. Spring loading and sintering are two techniques used.

The experimental heat pipe wick used for this project was a layer of Alcan Metal Powders, Alcan 103A copper shot. This shot is microscopic in diameter. It was poured around tapered, greened stainless steel mandrels 57 and sintered in place. The mandrels were then removed, leaving a wick of the copper powder firmly bonded to the inner wall of the heat pipe. FIG. 6 shows the tapered stainless steel mandrels 57 partially withdrawn from the heat pipes. FIGS. 7A and 7B show the sintered wick 58 within the heat pipes. Sintered shot is advantageous compared to the other materials mentioned in being easy to form in place, stable in operation, and providing a large number of paths for return flow of the liquid.

The wick is formed into the collector subassembly during tube manufacture. This subassembly with dry, hermetically sealed heat pipes is then joined to the tube. The tube is then exhausted and sealed while using normal bakeout procedures. The heat pipe structure is then opened by cutting open the sealed tubulation 56 and water, or other coolant, is then added to the tube at room temperature. The surplus water is removed and the tubulation 56 is nipped off. Water filling is a simple procedure and takes less than five minutes once a tube is turned on for the first time.

The water is added in excess of the final desired filling. The tube is heated to drive off air and excess water vapor. A mirror is placed over the end of the tubulation 56 in order to detect the vapor being driven off. At first the vapor comes in bursts. When the bursts end, approximately the optimum amount of water remains and the tubulation is nipped. The optimum amount of water is that which fills the wick during operation and leaves the open space of the heat pipe to water vapor.

Figure 8:
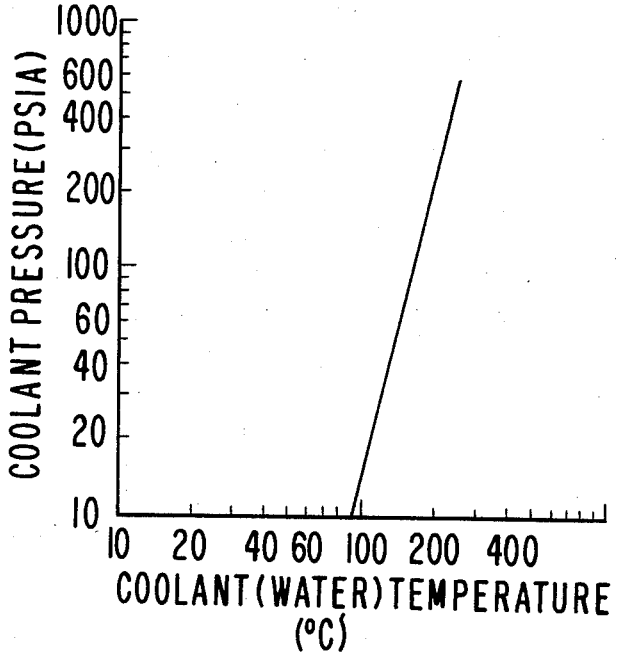
FIG. 8 is a plot of coolant pressure versus coolant temperature in the heat pipe for a water coolant.

It was noted that the temperatures of the heat pipe inner walls ($T_6$ and $T_7$, FIG. 2*b*) operate nearly isothermally. The $\Delta T$ between $T_6$ and $T_7$ can be calculated from the pressure difference within the heat pipe using the Clausius-Clapeyron equation. The heat pipe will not return the condensed liquid in the wick without a $\Delta P$ and, therefore, a $\Delta T$. The vapor and liquid water temperatures on the inner walls are nearly equal and are between $T_6$ and $T_7$. The vapor/liquid temperature is actually determined by the vapor pressure curve for water as shown in FIG. 8. For example, if the vapor/-liquid is at 210 PSIA (195 PSIG), then the water coolant is 197° C. With $T_6 \approx T_7 \approx 197°$ C., then $T_8 \approx 190°$ C. and $T_5 > 200°$ C. When increasing the airflow rate, but when holding the input power constant, all four temperatures are reduced by about the same $\Delta T$. An increase in input power, but with no increase in airflow, increases all four temperatures by about the same $\Delta T$.

The purpose of the evaluation tests was to determine if the addition of heat pipes to a tube with a conventional reentrant collector in a linear beam tube, such as the VKU-7791J1 klystron, would operate with a cooler inner collector core with the same power and cooling airflow rate and show appreciably higher power handling capability for the tube with a minimal increase in air flow. A heat pipe can operate with most any orientation, but reduction in power handling occurs when the evaporator is held above the condenser. The intended usage for this tube is a ground based, klystron amplifier installation. This evaluation was limited to a vertical orientation and with the condenser region above the evaporator region as shown in FIG. 1.

A full appreciation for the benefits of the heat pipe collector can be realized only when ⅛ tube data has been normalized to a full tube condition. All ⅛ tube input power data and volumetric airflow data have, therefore, been corrected to full tube size. This data can, therefore, be compared to the VKU-7791J performance characteristics.

Figure 9:
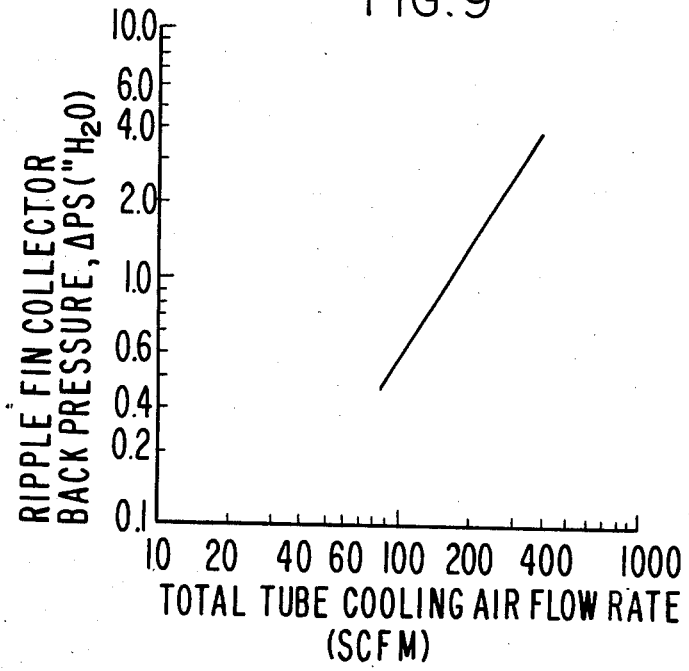
FIG. 9 is a plot of the back pressure of coolant air versus flow rate for ripple fins used in the invention for a full tube.

Airflow pressure drop data for a full scale tube are presented in FIG. 9. The only airflow specified in the VKU-7791 data sheet is 1000#/hour; no pressure drop is given. At ambient sea level this equates to 222 SCFM. At this airflow, the ripple finned tube has 1.6" $H_2O$ of back pressure.

Table I is a summary of the projected operating temperature characteristics when a full scale, heat pipe cooled tube is operating at 8.8 kW thermal dissipation.

TABLE I

Heat Pipe Cooled Tube: 8.8 kW Thermal Dissipation (≅2 kW Output)

| Full Size Tube Volumetric Airflow (SCFM) | Fin/Core (°C.) | Temp. Heat Pipe Coolant (°C.) | Inner Core (Avg) (°C.) | Resulting Pipe Vapor Pressure (PSI) | Resulting Collector Airflow Pressure Drop ($H_2O$") |
|---|---|---|---|---|---|
| 152 | 178 | 190 | 232 | 182 | 0.88 |
| 224 | 158 | 164 | 211 | 102 | 1.65 |
| 280 | 132 | 136 | 195 | 49 | 2.35 |
| 344 | 114 | 120 | 175 | 29 | 3.25 |

Figure 10:
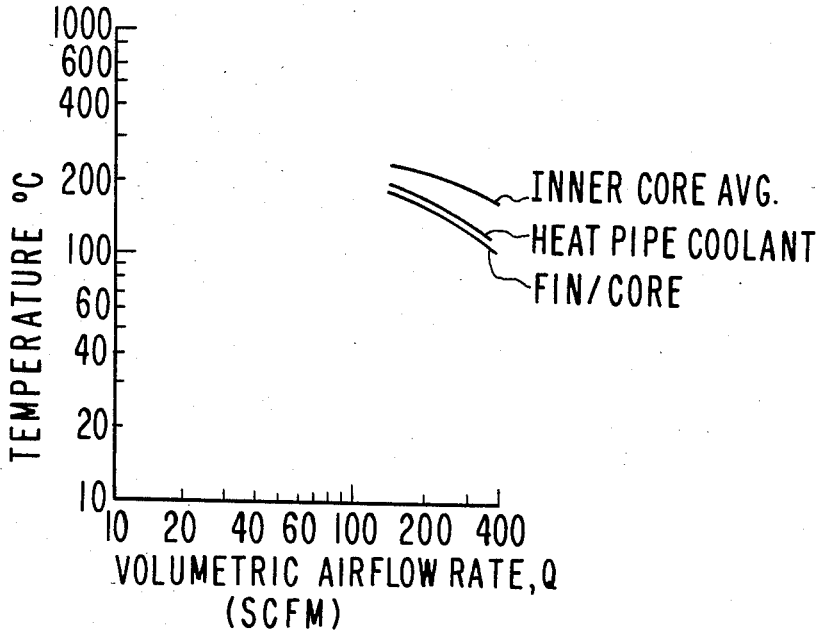
FIG. 10 shows plots of predicted temperature at various places versus airflow rate for a 7791 klystron tube operating at 8.8 kW dissipation.

These temperature data are shown in FIG. 10. Note that with an actual 7791 klystron having a 936 type collector, a thermocouple detected a 695° C. inner core temperature when dissipating 8.8 kW and when cooled with 288 SCFM. This airflow is used for this comparison rather than the specified 222 SCFM as the solid core tube data had been taken at this airflow rate. The heat pipe cooled tube had a comparable core temperature at 288 SCFM of 190° C. The addition of heat pipes may cool the solid core VKU-7791 by about 505° C. (=695−190). FIG. 10, a plot for the case of Table I of temperature versus airflow rate, also demonstrates that with heat pipe cooling, an increase in the cooling airflow rate reduces the collector core temperature.

The next question is how much power can be safely dissipated with a 7791 klystron using heat pipe cooling. First, it shall be assumed that the heat pipe structure is pressure limited; limited to 250 PSIA, for example. FIG. 8 shows that 250 PSIA results from a 205° C. water vapor.

Table II shows the full tube power dissipation capability at various airflows and with 205° C. coolant.

TABLE II

Power Dissipation with 250 PSIA (205° C.) Vapor

| Full Size Tube Volumetric Airflow (SCFM) | Col. Dissipation (Watts) | Tube RF Output Power (Watts) | Resulting Inner Core Temperature (°C.) | Resulting Aircooler Pressure Drop ($H_2O$") |
|---|---|---|---|---|
| 152 | 9,600 | 1776 | 248° C. | 0.90 |
| 224 | 10,880 | 2013 | 262° C. | 1.68 |
| 280 | 14,800 | 2738 | 295° C. | 2.35 |
| 344 | 16,000 | 2960 | 300° C. | 3.23 |

Figure 11:
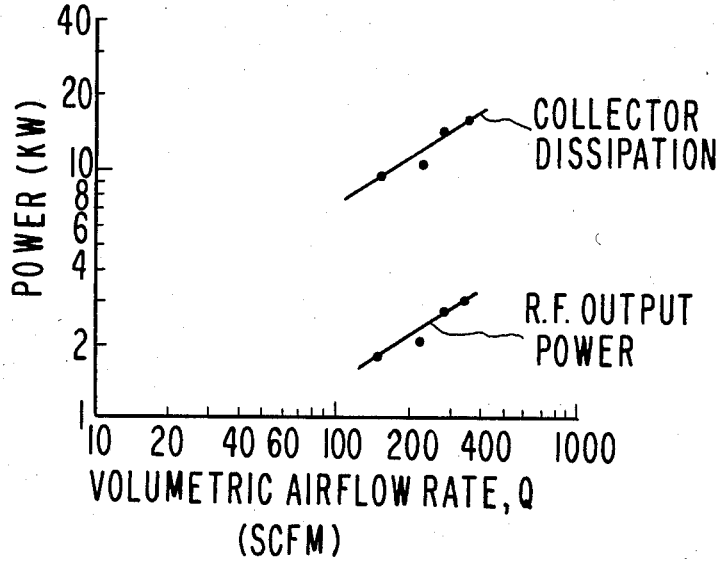
FIG. 11 shows a plot of collector dissipation power and RF output power versus volumetric airflow rate at 250 PSIA vapor pressure.

The Table II data is presented in FIG. 11. Note that by increasing the full tube airflow from 220 SCFM to 340 SCFM, the collector dissipation increases from 12.2 kW to 16 kW and the tube output will increase from 2.26 kW to 3 kW. This is with the heat pipe vapor maintained at 250 PSIA (or 205° C.). The air-cooling pressure drop will increase from 1.68 "$H_2O$ to 3.23" for this increased airflow.

The average temperature of the inner core of the collector will increase from 262° C. to only 300° C. with this increase in power; this is 395° C. cooler (=695−300) than when operating the solid core tube with only 8.8 kW dissipation.

The above discussion was based on a pressure limitation for the heat pipe structure. Heat pipes are also limited by their capability to transfer the heat from the internal evaporator surface. This limit has an experimentally found maximum power density of 144 watts/cm$^2$.

This theoretical value essentially directs the design engineer to include area enhancement rods to the evaporator surface, as shown in FIG. 3.

Calculations show that if all of the beam power were to be distributed over the bottom 1.04" of the collector core of the sull-scale tube when dissipating 10 kW, the vaporizing area would result in 115 watts/cm$^2$; very close to the 144 watts/cm$^2$ experimental limit. By machining seven 0.080" gaps circumferentially into the bottom of the heat pipes, the vaporization power density drops to 81 watts/cm$^2$; a conservative value.

Figure 4B:
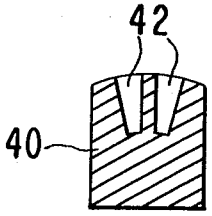
Figure 4C:
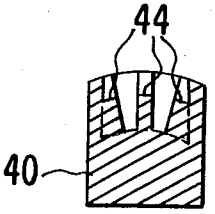
Figures 12A, 12B, 12C, 13, 14, 15:
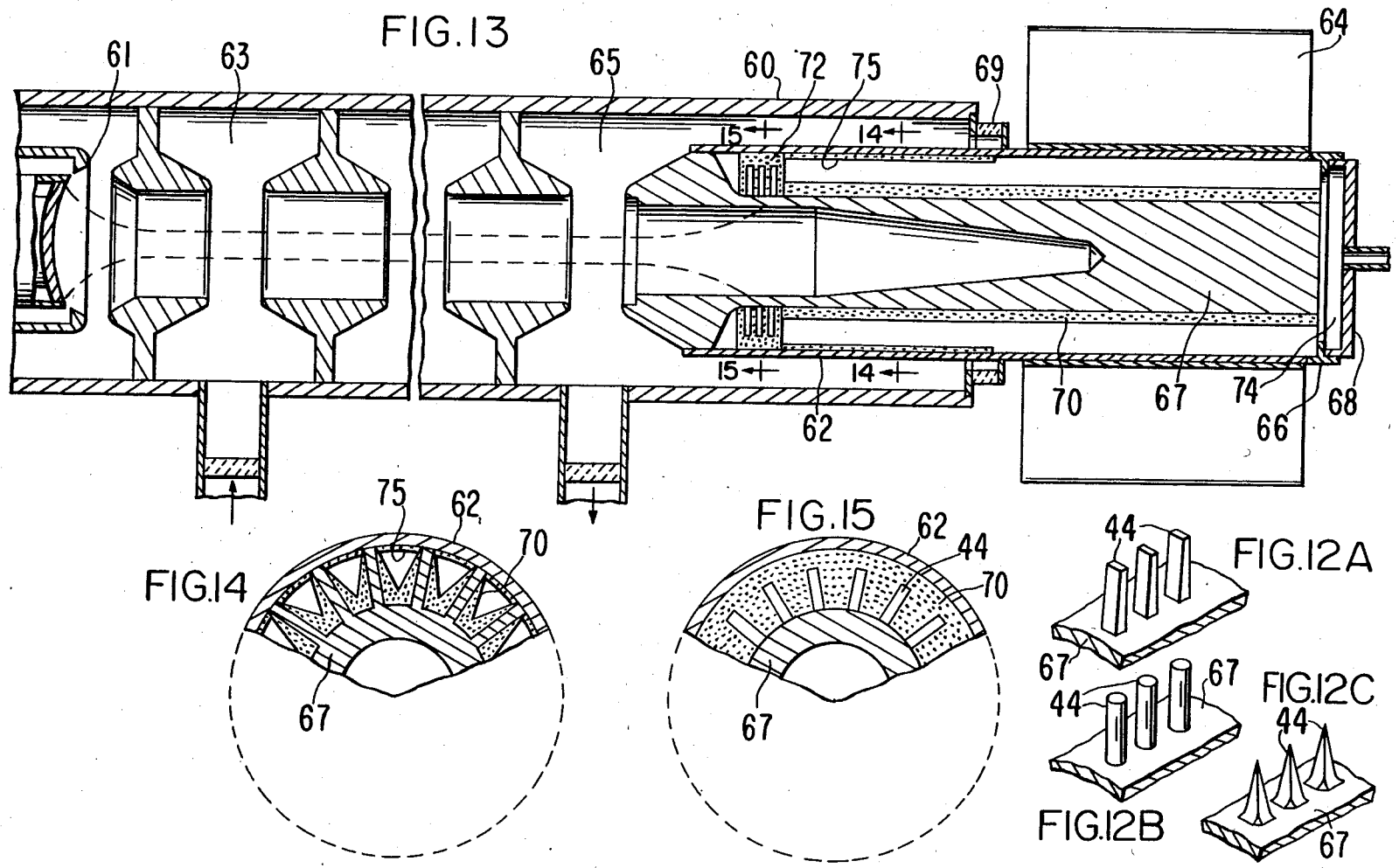
FIG. 13 shows assembly of the heat transfer device of the invention into a klystron tube.
FIG. 14 is a sectional view through the tube of FIG. 13 in the center of the heat pipes.
FIG. 15 is a sectional view through the tube of FIG. 13 near the heat source end of the heat pipes.

Various configurations of vapor surface area enhancement rods are possible as shown in FIG. 4 or FIG. 12. The goal is to minimize entrapment of vapor under the rods. Flat surfaces as shown in FIG. 4 are the easiest to manufacture but have the greatest tendency to trap vapor bubbles. A tapered rod as shown in FIG. 12*a*, a cylindrical rod as shown in FIG. 12*b* or a pointed rod as shown in FIG. 12*c* can be used to reduce entrapment of bubbles. Smooth rounded corners are preferred everywhere in the heat pipe except at the tips of the rods. Extending the rods only partially to the outer wall minimizes vapor entrapment.

In FIGS. 13–15 a heat transfer arrangement according to the invention is shown assembled into a klystron tube. An electron gun 61 is used to inject a beam into an input cavity 63 which beam in time passes through an output cavity 65 and ends in a collector 67. The collector 67 is electrically and thermally insulated from the tube body 60 with a standoff ring 69. The collector 67 has integral grooves 42 and a cylindrical cover 62. Fins 64 are attached to the cylindrical cover 62. A rim 66 and cap 68 seal the heat pipes. Within the heat pipes sintered copper forms the wick 70. Circumferential channels 72 and 74 interconnect the heat pipes to enhance heat transfer by having the elements of the heat pipes operate in parallel. Vapor surface area enhancement rods 44 are used to enhance heat transfer. For best operation, the wick 70 should not be touching the cylindrical cover 62 in the vicinity of the fins, but should be in contact with the cylindrical cover 62 in the evaporation region 75.

This invention is not limited to the preferred embodiment and alternatives heretofore described, to which variations and improvements may be made, including mechanically and electrically equivalent modifications to component parts, without departing from the scope of protection of the present patent and true spirit of the invention, the characteristics of which are summarized in the following claims.

What is claimed is:

1. An apparatus for cooling a linear beam tube having a beam collector, comprising:

heat pipe means for conducting heat from a beam collector to an outer extremity of the tube, said heat pipe means including a multiplicity of channels formed integrally to a tube cavity wall from the vicinity of the beam collector to the outer extremity, said channels being partially filled with a liquid, area enhancement rods formed in said heat pipe means in the vicinity of the beam collector, said area enhancement rods extending from a wall closest to a surface where an electron beam impinges on the beam collector, said area enhancement rods not extending to an opposite wall, and a wick of porous materials formed on the walls of said channels.

2. An apparatus as in claim 1 including cooling fins attached to an exterior of said outer extremity.

3. An apparatus as in claim 2 including means for interconnecting said channels in the vicinity of the beam collector and at said outer extremity.

4. An apparatus as in claim 1 wherein said wick is formed of sintered metal powder.

5. The apparatus of claim 1 including first interconnection means for interconnecting each channel at a first end of each channel and second interconnection means for interconnecting each channel at a second end of each channel.

6. The apparatus of claim 2 including first interconnection means for interconnecting each channel at a first end of each channel and second interconnection means for interconnecting each channel at a second end of each channel.

7. The apparatus of claim 3 including first interconnection means for interconnecting each channel at a first end of each channel and second interconnection means for interconnecting each channel at a second end of each channel.

8. The apparatus of claim 4 including first interconnection means for interconnecting each channel at a first end of each channel and second interconnection means for interconnecting each channel at a second end of each channel.

9. An improvement in a linear beam vacuum tube having a beam collector formed in a walled cavity, and having air cooling fins attached to the exterior of the walls at an outer extremity, the improvement comprising:

a plurality of heat pipe means formed integrally in the walls of the cavity, said heat pipe means extending from the beam collector to the outer extremity, said heat pipe means each including a wick of porous materials formed on a wall of each heat pipe, said heat pipe means each including area enhancement rods in the vicinity of the beam collector, said area enhancement rods extending from a wall closest to a surface where an electron beam impinges on the beam collector, said area enhancement rods not extending to an opposite wall, a cooling fluid in said heat pipe, and each heat pipe being interconnected with each neighboring heat pipe at both ends of each heat pipe.

10. An improvement in a linear beam vacuum tube as in claim 9 wherein said wick is formed of sintered metal powder.

11. A linear beam tube comprising:

a cathode, a beam collector, a vacuum envelope, having interior and exterior walls, said beam collector forming part of the interior wall of said vacuum envelope, external fins for air cooling attached to said exterior walls of said vacuum envelope, multiple heat pipes formed integrally in said vacuum envelope between the interior and exterior walls, each said heat pipe including a wick means of sintered metal powder for providing a return flow path of liquid, each said heat pipe including area enhancement rods, said area enhancement rods extending from a wall inside said heat pipe means closest to a surface where an electron beam impinges on said beam collector, said area enhancement rods not extending to an opposite wall, means for interconnecting each heat pipe at a first end of each heat pipe, and means for interconnecting each heat pipe at a second end of each heat pipe.

* * * * *